US008099185B2

(12) United States Patent
Dickerson

(10) Patent No.: US 8,099,185 B2
(45) Date of Patent: Jan. 17, 2012

(54) CONTROL METHOD FOR GARMENT SEWING

(76) Inventor: Stephen Lang Dickerson, Atlanta, GA (US)

( * ) Notice: Subject to any disclaimer, the term of this patent is extended or adjusted under 35 U.S.C. 154(b) by 980 days.

(21) Appl. No.: 12/047,103

(22) Filed: Mar. 12, 2008

(65) Prior Publication Data

US 2008/0228312 A1 Sep. 18, 2008

Related U.S. Application Data

(60) Provisional application No. 60/894,512, filed on Mar. 13, 2007.

(51) Int. Cl.
*G06F 19/00* (2011.01)

(52) U.S. Cl. ..... 700/132; 700/136; 700/134

(58) Field of Classification Search ..... 700/130–137
See application file for complete search history.

(56) References Cited

U.S. PATENT DOCUMENTS

| | | | | |
|---|---|---|---|---|
| 3,721,809 | A | 3/1973 | Strandberg, Jr. et al. | |
| 4,404,919 | A * | 9/1983 | Martell et al. | 112/470.03 |
| 4,632,046 | A | 12/1986 | Barrett et al. | |
| 4,658,741 | A * | 4/1987 | Jehle et al. | 112/470.02 |
| 5,416,593 | A * | 5/1995 | Vercruysse | 356/429 |
| 6,220,687 | B1 | 4/2001 | Takahashi et al. | |
| 6,499,513 | B1 | 12/2002 | Couch | |
| 2002/0020332 | A1 | 2/2002 | Hartsell et al. | |
| 2004/0129190 | A1 | 7/2004 | Sawada et al. | |

OTHER PUBLICATIONS

"US Apparel Automation Initiatives in a Nutshell", presented by Sundaresan Jayaraman, Jul. 11, 2007.

"The Impact of New Technology in the Clothing Industry: Outlook to 2000," by Chris Byrne. This paper originally produced for the International Labour Office in Geneva.

"Trends in Japanese Textile Technology," by John E. Berkowitch. Prepared for U.S. Department of Commerce, Office of Technology Policy, Asia-Pacific Technology Program, Sep. 1996.

* cited by examiner

*Primary Examiner* — Nathan Durham

(74) *Attorney, Agent, or Firm* — Next IP Law Group LLP; Minh N. Nguyen, Esq.

(57) ABSTRACT

Embodiments of the present invention provide a system and device for making garment. One embodiment, for example, includes a system that comprises a processing device and a sewing module that sews garment material to facilitate making the garment. The system further comprises memory that includes a thread count manager having instructions stored in the memory. The instructions are executed by the processing device and include logic configured to instruct the sewing module to sew the garment material based on counting threads of the garment material rather than using the geometric shape of pieces of garment material.

22 Claims, 7 Drawing Sheets

CONTROL METHOD FOR GARMENT SEWING

CROSS-REFERENCE TO RELATED APPLICATION

This application claims priority to copending U.S. provisional application entitled, "Control Method For Garment Sewing," having Ser. No. 60/894,512, filed Mar. 13, 2007, which is entirely incorporated herein by reference.

TECHNICAL FIELD

The present invention is generally related to systems, apparatuses, and methods that cut and/or sew garment and, more particularly, is related to systems, apparatuses, and methods that cut and/or sew garment based on counting and/or orientation of the threads.

BACKGROUND

The process of making garment still relies on human labor to cut and sew the fabrics together. As a result, many countries, such as the France, United Kingdom, Germany, and the United States, lost many of their textile factories as a result of cheap labor overseas, mainly to developing countries in South East Asia, the Indian subcontinent and more recently, Central America. Before the textile factories moved to developing countries, some developed countries tried to automate the process of making garment but were unsuccessful.

SUMMARY

Embodiments of the present invention provide a system and device for making garment. One embodiment, for example, includes a system that comprises a processing device and a sewing module that sews garment material to facilitate making the garment. The system further comprises memory that includes a thread count manager having instructions stored in the memory. The instructions are executed by the processing device and include logic configured to instruct the sewing module to sew the garment material based on counting threads of the garment material rather than using the geometric shape of pieces of garment material.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Exemplary systems are first discussed with reference to the figures. Although these systems are described in detail, they are provided for purposes of illustration only and various modifications are feasible.

Figure 1:
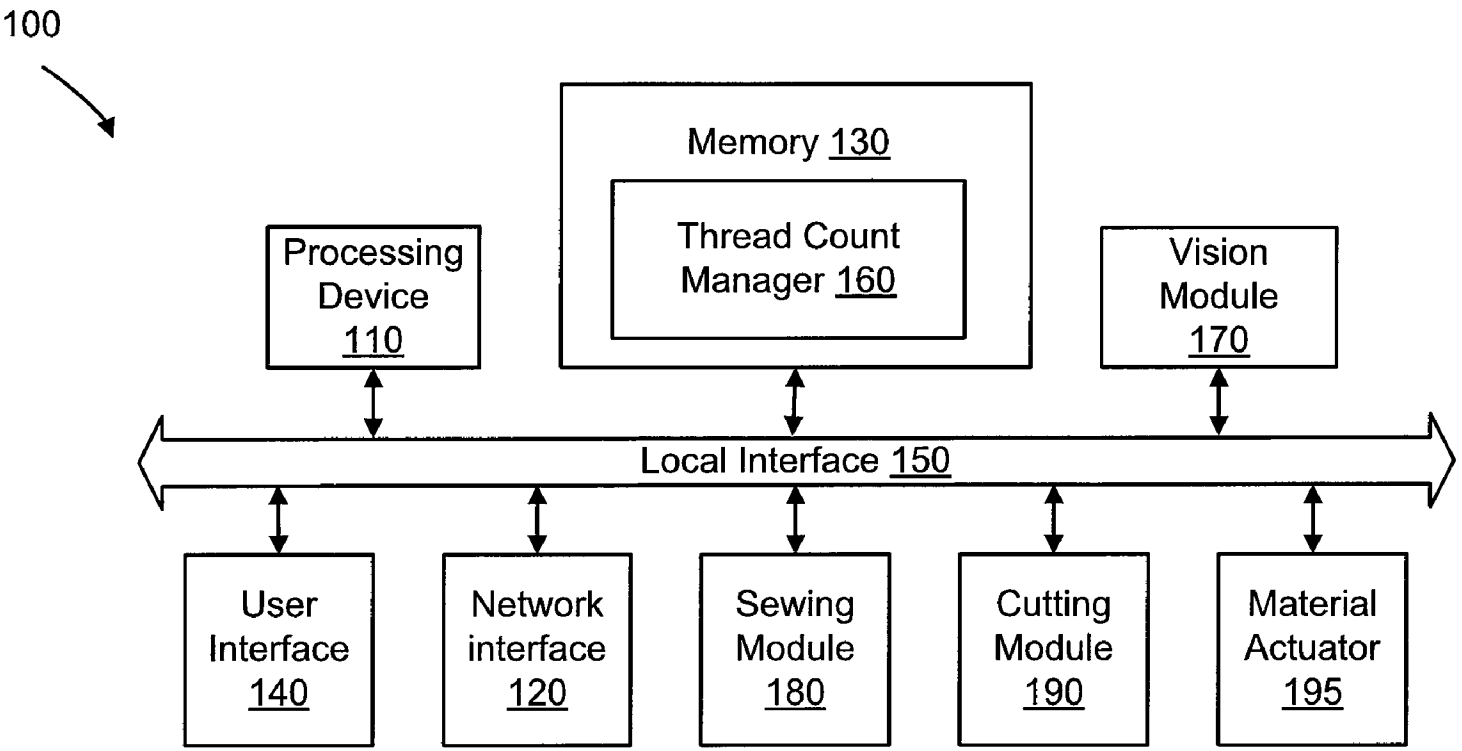
FIG. 1 is a block diagram of an embodiment of a system that makes garment.

FIG. 1 is a block diagram of an embodiment of a system that makes garment. As indicated in FIG. 1, the system 100 comprises a processing device 110, memory 130, one or more user interface devices 140, one or more networking devices 120, one or more vision modules 170, one or more sewing modules 180, one or more cutting modules 190, and one or more material actuators 195, each of which is connected to a local interface 150. The local interface 150 can be, for example, but not limited to, one or more buses or other wired or wireless connections, as is known in the art. The local interface 150 may have additional elements, which are omitted for simplicity, such as controllers, buffers (caches), drivers, repeaters, and receivers, to enable communications. Further, the local interface 150 may include address, control, and/or data connections to enable appropriate communications among the aforementioned components.

The processing device 110 can include any custom made or commercially available processor, a central processing unit (CPU) or an auxiliary processor among several processors associated with the camera 100, a semiconductor based microprocessor (in the form of a microchip), or a macroprocessor. Examples of suitable commercially available microprocessors are as follows: a PA-RISC series microprocessor from Hewlett-Packard Company, an 80×86 or Pentium series microprocessor from Intel Corporation, a PowerPC microprocessor from IBM, a Sparc microprocessor from Sun Microsystems, Inc, or a 68xxx series microprocessor from Motorola Corporation.

The networking devices 120 comprise the various components used to transmit and/or receive data over the network, where provided. By way of example, the networking devices 120 include a device that can communicate both inputs and outputs, for instance, a modulator/demodulator (e.g., modem), a radio frequency (RF) or infrared (IR) transceiver, a telephonic interface, a bridge, a router, as well as a network card, etc. The camera 100 can further includes one or more I/O devices (not shown) that comprise components used to facilitate connection of the camera 100 to other devices and therefore, for instance, comprise one or more serial, parallel, small system interface (SCSI), universal serial bus (USB), or IEEE 1394 (e.g., Firewire™) connection elements.

The vision module 170 can facilitate counting threads of a garment material as well as inspecting for defects on the garment material during a cutting operation. The vision module 170 can further facilitate detecting markings on the garment material before cutting or sewing the garment material.

The material actuator 195 facilitates moving the garment materials during the cutting and sewing operations.

The cutting and sewing modules 180, 190 facilitate cutting and sewing the garment materials together, respectively. In one embodiment, the sewing module 180 can be configured to sew the perimeter or markings on the garment material based on tracking a pattern that amounts to following a predetermined sequence of thread counts and/or the orientation of threads. Alternatively or additionally, the sewing module 180 is can be to sew two or more pieces of material together based on a predetermined sequence of thread counts and/or the orientation of threads for both parts, resulting in a sewn garment. Alternatively or additionally, the thread count of a cut piece is measured after cutting by the cutting module 190 and used by the sewing module 180 to sew two or more pieces together based on a calculated sequence of thread counts and/or the orientation of threads for both parts resulting in a sewn garment.

The memory 130 can include any one or a combination of volatile memory elements (e.g., random access memory (RAM, such as DRAM, SRAM, etc.)) and nonvolatile memory elements (e.g., ROM, hard drive, tape, CDROM, etc.). The one or more user interface devices comprise those components with which the user (e.g., administrator) can interact with the camera 100.

The memory 130 normally comprises various programs (in software and/or firmware) including at least an operating system (O/S) (not shown) and a thread count manager 160. The O/S controls the execution of programs, including the thread count manager 160, and provides scheduling, input-output control, file and data management, memory management, and communication control and related services. The thread count manager 160 facilitates the process for cutting and sewing garment material based on thread counts and/or orientation of the threads. For example, the thread count manager 160 includes instructions stored in the memory 130. The instructions comprise logic configured to instruct the sewing module 180 to sew the garment material based on counting threads of the garment material. Optionally, the instructions comprise logic configured to instruct the sewing module 180 to sew the garment material based on the orientation of the threads. Yet another option, the instructions comprise logic configured to instruct the cutting module 190 to cut the garment material based on counting the threads of the garment material.

The thread count manager 160 can be embodied in any computer-readable medium for use by or in connection with any suitable instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device.

The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

A nonexhaustive list of examples of suitable commercially available operating systems is as follows: (a) a Windows operating system available from Microsoft Corporation; (b) a Netware operating system available from Novell, Inc.; (c) a Macintosh operating system available from Apple Computer, Inc.; (e) a UNIX operating system, which is available for purchase from many vendors, such as the Hewlett-Packard Company, Sun Microsystems, Inc., and AT&T Corporation; (d) a LINUX operating system, which is freeware that is readily available on the Internet; (e) a run time Vxworks operating system from WindRiver Systems, Inc.; or (f) an appliance-based operating system, such as that implemented in handheld computers or personal data assistants (PDAs) (e.g., PalmOS available from Palm Computing, Inc., and Windows CE available from Microsoft Corporation). The operating system essentially controls the execution of other computer programs, such as the thread count manager 160, and provides scheduling, input-output control, file and data management, memory management, and communication control and related services.

Figure 2:
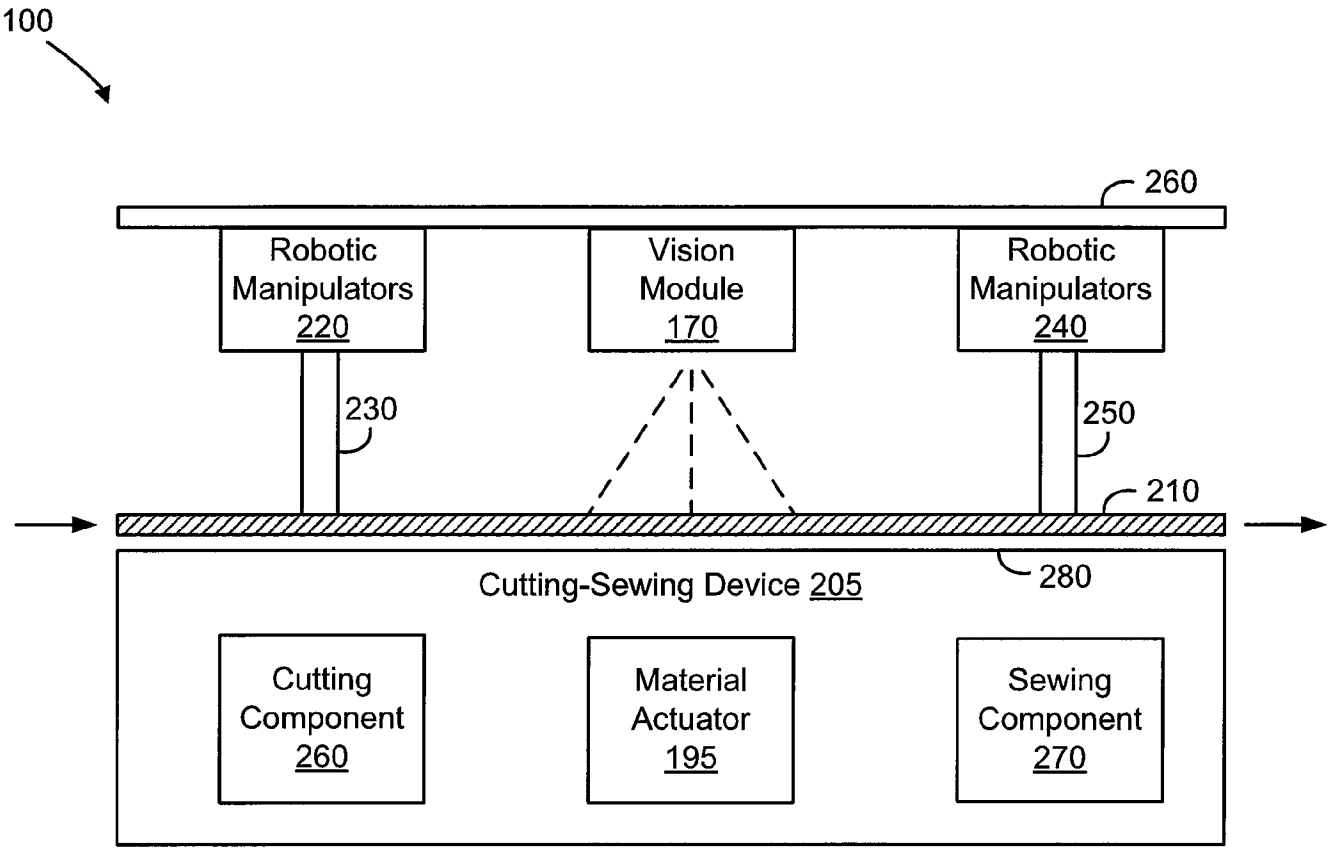
FIG. 2 is a side view of the system, such as that shown in FIG. 1, that makes garment.

FIG. 2 is a side view of the system 100, such as that shown in FIG. 1, that makes garment. In this embodiment, the system 100 includes a top railing 260 that is mechanically coupled to robotic manipulators 220, 240. The manipulators 220, 240 are coupled to cutting and sewing heads 230, 250, respectively. The cutting and sewing heads 230, 250 are coupled to cutting and sewing components 260, 270 of a cutting-sewing device 205, respectively, which facilitates cutting and sewing garment materials 210 in the sewing assembly.

The cutting-sewing device 205 includes a material actuator 195 that facilitates moving the garment material 210 across the top surface 280 of the device 205. The motion of the garment material 210 can be accomplished in part by mechanisms (not shown) at the top surface 210 of the cutting-sewing device 205 such as rollers or balls with internal vacuum and driven by motors, or alternatively, by air jets embedded in the cutting-sewing device 205 or slightly protruding. Such jets may include pulse width modulation, pulse width modulation (PWM), or air.

The robotic manipulators 220, 240 can move the cutting and sewing heads 230, 250 in any direction around the top surface 280 of the cutting-sewing device 205. The motion of the garment material 210 can be accomplished in part by robotic arm above the cutting-sewing device 205 with a garment material gripper at the end of arm. Such a gripper can depend on various prior art methods of garment material grasping. It should be noted that the motion of the garment material 210 and corresponding motion of items in and above the cutting-sewing device 205 is generally determined by a computer using a combination of sensory inputs. The sensor sets include a combination of vision and force sensors.

The cutting-sewing device 205 is shown in FIG. 2 as a single device but it should be appreciated that a separate cutting device (not shown) and a separate sewing device (not shown) with the cut material being moved between the devices can be accomplished. This can include a manual motion which makes the process less than totally automatic. It can also include such traditional part movement devices such as conveyors. Alternatively or additionally, the separate cutting device and separate sewing device may include storage of cut pieces and/or partial assemblies between device elements. Such storage is typically called a buffer. This can optimize the cutting process to minimize waste. The cutting-sewing device 205 is further described in relation to FIGS. 5-8.

Figure 4:
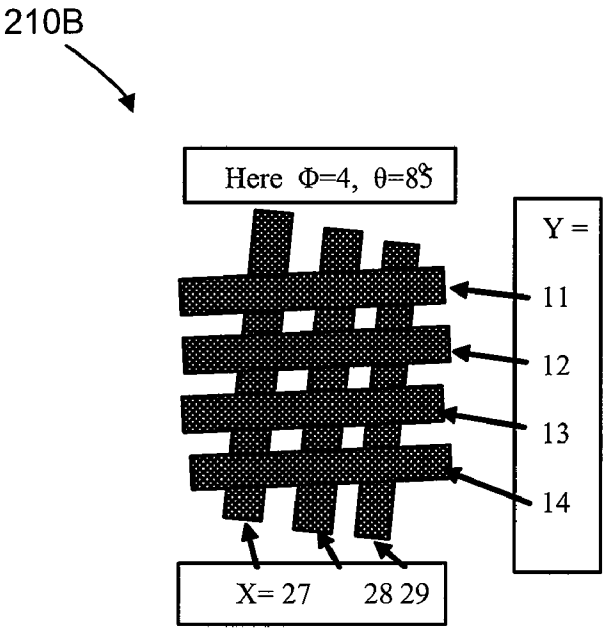
FIGS. 3 and 4 are top views of a garment material that is used to make garment in the garment making system, such as that shown in FIGS. 1 and 2.
Figure 3:
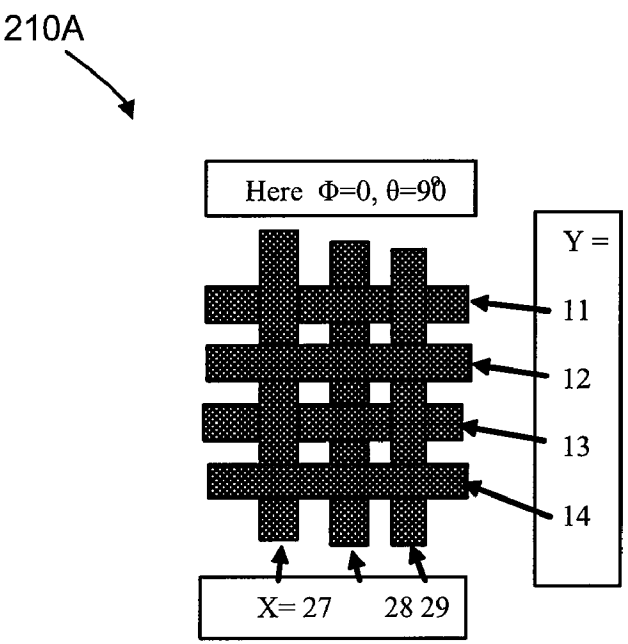

FIGS. 3 and 4 are top views of a garment material 210 that is used to make garment in the garment making system, such as that shown in FIGS. 1 and 2. The garment material 210 includes at least one of the following materials: woven material and non-woven material. The woven material includes, but is not limited to, textile and fabric and the non-woven material includes, but is not limited to, leather. In this disclosure, the woven material can further include knit material.

The non-woven material can be configured to be applied to its surface any feature that enables the system to count features instead of threads. The feature should be well-defined and maintain its attachment to the surface in the face of surface distortion. The feature includes marking the non-woven material with removable or washable ink. For example, the mark can be applied by a printing process, which includes ink jet or contact device. The feature is applied to the surface of the non-woven material for sewing in the face of surface distortion.

The garment material 210A, 210B has a structure that determines local Position, $\{X, Y, \phi, \theta\}$. This is non-Euclidean in the conventional engineering sense. Rather the Position represents thread counts and orientation. When the garment material 210 is sewn into a garment, the Position of the sewing thread in the stitches as well as the global Positional description of shape of the parts of the garment determines the "Shape" of the garment.

The geometry of the garment material 210 can be described by counts in a manner where the perimeter of the garment material is in a closed loop. The perimeter of the garment material 210 can be mathematically described as a closed shape by way of a two or three dimensional array of thread counts including orientation. The sewing and cutting module 180, 190 can cut and sew the garment material 210 based on the described geometry. Optionally, the orientation of the edge of the garment material can be described by the orientation in the warp or fill direction as the edge of the garment material is traversed. For example, the thread counting can be of the woven material where the thread count is based on warp and fill when weaving in a loom, the warp being in the machine direction and fill being in the cross direction. In another example, the thread counting can be of a knit material where thread count is based on the formations used in the woven material.

The garments are generally made of non-rigid material that can take a variety of shapes in the Euclidean sense, which makes the garments particularly desirable. When a garment is worn its shape changes while its "Shape," that is thread count, doesn't. It is also this characteristic that makes traditional sewing difficult to automate._Note that garment material 210A of FIG. 3 and 210B of FIG. 4 describe the same piece of garment material but the garment material 210B of FIG. 4 is the distorted version of garment material 210A of FIG. 4. Also note that Shape and Position are taken as the thread (or feature) count versions rather than the Euclidean version, shape and position.

There has been difficulty automating the sewing of garments partly because machines are designed based on Euclidean units of measure. The system 100 can automate the cutting and/or sewing processes entirely based on thread counts or, optionally, based on a combination of thread counts and Euclidean units of measure. To base the machines on the "Shape" seems to require automation that is sensory and computationally intensive so that the servos operate correctly. Servos are used generically here as devices that control motion.

Figure 5:
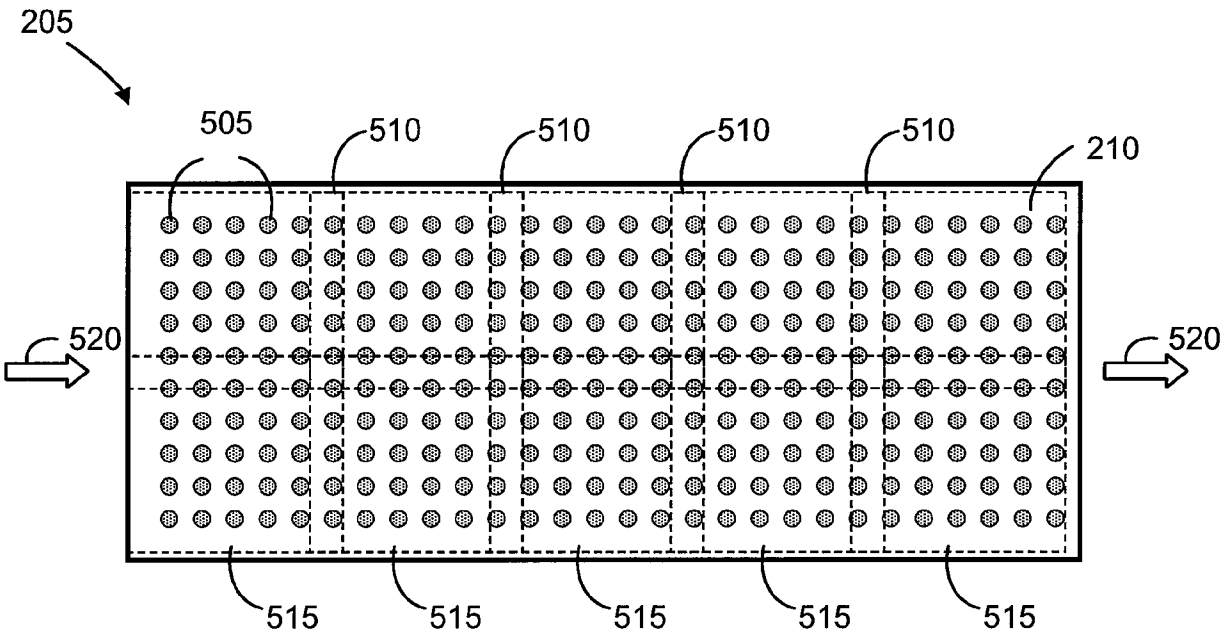
FIG. 5 is a top view of a cutting-sewing device of the garment making system, such as that shown in FIG. 2.

FIG. 5 is a top view of the cutting-sewing device 205 of the garment making system 100, such as that shown in FIG. 2. The top surface of the cutting-sewing device 205 can measure in the order of 2 meters×8 meters. Other dimensions of the cutting-sewing device 205 can be smaller or larger than the given measurements depending on the need and circumstances.

In one embodiment, the top surface of the cutting-sewing device 205 can be nominally flat with a large number of actuator heads 505 that are imbedded for the purpose of moving garment material 210 substantially horizontally as shown with arrow 520. The actuator heads 505 may contain Position or position measurement features. The movement of the garment material 210 using the actuator heads 505 can control the stress in the garment material 210 as it moves through the sewing head 640 (FIG. 6) and help with initial alignment of two garment parts to be sewn together. Final alignment is likely a function of the sewing head servo mechanism, including machine vision, before starting of sewing.

Figure 6:
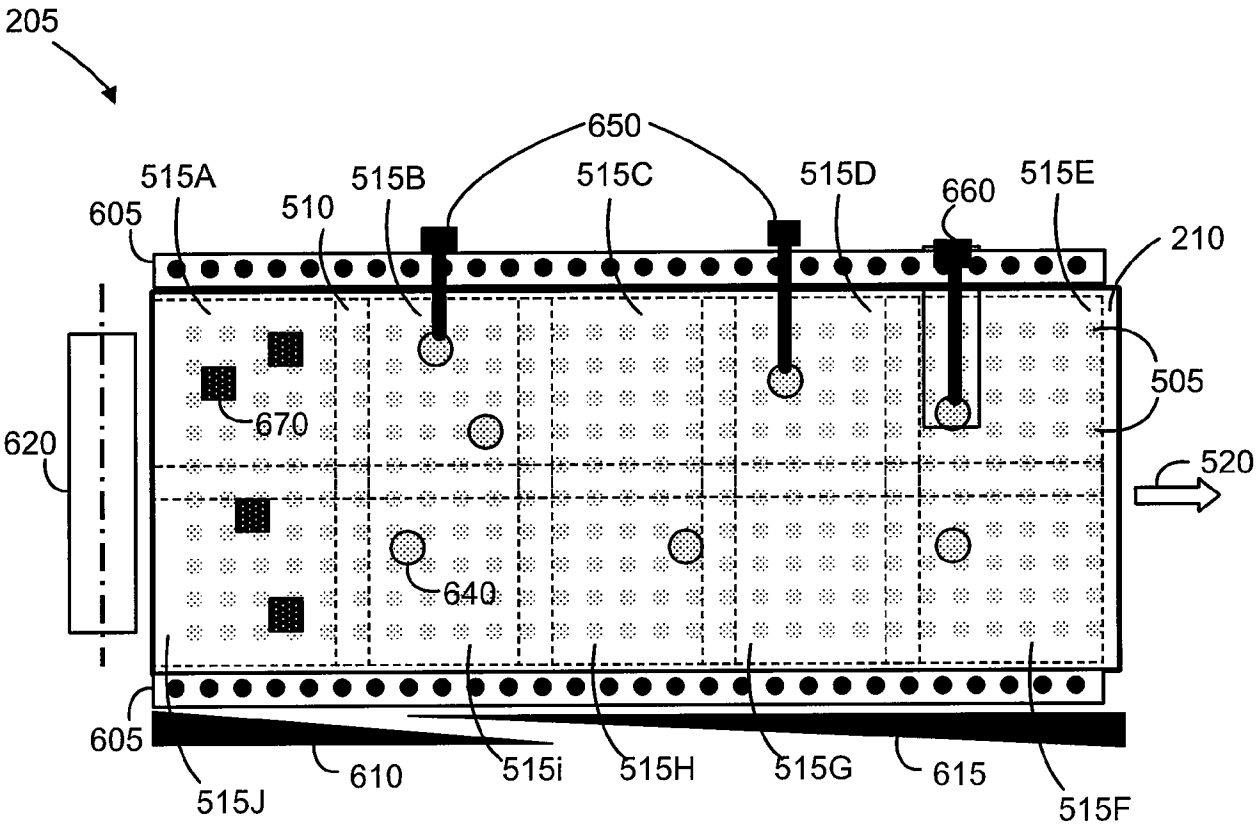
FIG. 6 is a top view of the cutting-sewing device, such as that shown in FIG. 5, having cutting heads, sewing heads and other garment making components.

FIG. 6 is a top view of the cutting-sewing device 205, such as that shown in FIG. 5, having cutting heads 670, sewing heads 640 and other garment making components. Above the cutting-sewing is the vision module 170 (FIG. 2) that facilitates providing global positions of pieces of the garment material 210 and parts made of two or more pieces.

In this embodiment, the vision module 170 can observe ten areas 515A-J of the top surface 210 of the cutting-sewing device 205. The ten areas 515A-J are shown as dotted rectangles with smaller dotted rectangles 510 as they overlap between the areas viewed by the ten vision modules. The observed areas 515A-J can include number of cutting components, such as cutting heads 670 in areas 515A, 515J, and sewing components, such as sewing heads 640 in areas 515B, 515D-F, 515H-I. The system 100 in FIG. 6 includes four cutting heads 670 and seven sewing heads 640.

The sewing and perhaps cutting heads 640, 670 can be robotically moveable using robotic manipulators 220, 240 (FIG. 2). The cutting heads 670 are configured to cut and optionally generate fiducial landmark. Fiducial landmarks are made with washable, perhaps colored markings, and are used in subsequent location observations for the purpose of, for example, sewing the garment materials 210 together. A local precise tracking of Position is maintained at the cutting heads 670 in the cutting and marking processes.

The sewing heads 640 can include at least one of the following forms for sewing: (1) special features, e.g., buttons and button holes, (2) special edge items, e.g., hems and addition of zippers, and (3) two pieces of garment materials 210 together. A local precise tracking of Position can be maintained at the sewing heads 640 and more than one such position tracking can be used if two or more garment material parts are sewn.

It should be appreciated that the robotic manipulators 220, 240 (FIG. 2) may provide for faster global garment material movement than available from the actuator heads 505 of the cutting-sewing device 205. Alternatively or additionally, the robotic manipulators 220, 240 may provide some "straightening" of the garment material parts during the cutting and sewing process. The top surface 210 of the cutting-sewing device 205 may include local features built in, such as holes that accomodate the sewing heads 640 to facilitate sewing the garment materials 210.

In this embodiment, the cutting-sewing device 205 can start with a roll of cloth 620 and completely automatically produce an assembled garment at the nominal rate of, for example, 1 per minute. The cutting heads 670 can be driven by overhead robotic manipulators 220, 240 (FIG. 2) and cut the garment material 210 into pieces based on thread count. Laser cutting of one layer is a candidate mechanism. The garment material 210 can be stationary during the cutting process. Part of the cutting process would include the precise placement of fiducial landmarks 715 (FIG. 7) on the garment material 210 for later use. Fiducial landmarks would be used for alignments of various items and perhaps during the sewing process. The cutting and sewing processes can be done in the cutting and sewing sections 610, 615 of the cutting-sewing device 205, respectively.

The sewing heads 640 can be stationary, but may have rotary drives to change the direction of the garment material 210 through the heads 640. These heads 640 can be complex as tracking and servo control, stitch by stitch, of two garment pieces, for example, from above and below may be used. The actual number and type of heads 640 would be set up for the particular type of garment being produced. The heads 640 would be fastened in position on the mounting rails 605 on each side. Some heads 640 would be highly specialized for example containing folding or button attachment. Some heads 640 might include a mandrel 660 protruding into the workspace to allow more complex shapes. Some heads 640 can be supported as a separate sewing machine 650.

Figure 7:
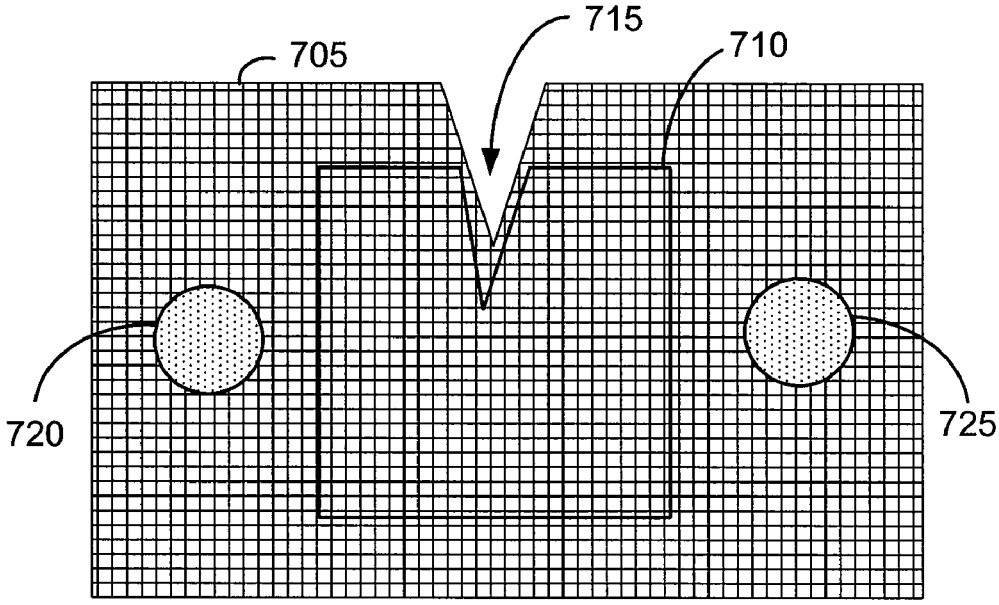
FIG. 7 is a top view of a garment material that has been marked before the garment material is cut and/or sewed.

FIG. 7 is a top view of the garment material 705 that is to be cut and/or sewed. As described in relation to FIGS. 3 and 4, the vector $\{X, Y, \phi, \theta\}$ can be measured locally by a low-resolution vision imaging device 170 (FIG. 2) or other optical devices with a small field of view much like the device in an optical mouse. In FIG. 7, successive images are correlated at a rate that removes ambiguity in the incremental values of X and Y and absolute values of $\phi,\theta$. For example, if the garment material 705 was moving at a rate of, e.g., 10 cm/sec. with a pitch in the threads of, e.g., 40 threads/cm, the thread count would typically increment at 400 threads/sec. Thus, the vision imaging device 170 would perhaps capture 1600 images per second to accurately count the threads. Alternatively or additionally, the rotational rate would be limited so that the maximum rate within the image is limited by the same 400 threads/sec. The actual image capture rate for cutting and sewing can be influenced by external logic that takes advantage of a priori knowledge of velocity of fabric movement.

Cutting pads 720, 725 are generally disposed on top of the garment material 705. Cutting should be done one garment part at a time in order to maintain the Shape. Typically in sewing operations many layers are cut at once with reciprocating blades. The system can cut one part at a time but can be designed to cut many different parts. The cutting pads 720, 725 can make measurements as above when cutting. Cutting by a miniaturized version of the common cutting blade is an alternative. Cutting based on laser, water jet, or extremely fast circular cutter is also possible. The garment material 705 can be cut into the desired geometric shape having a cut mark 715. The cutting pads 720, 725 would also have the ability to make fiducial marks with a washable ink. Such markings would not only be along an edge or in the interior, but might define the location of a button hole, for example. The cut material 715 is marked as part of the cutting process so as to facilitate subsequent sewing and/or cutting operation. The local vision system 170 can project a field of view 710 on the garment material 705 for counting threads and orientation of threads.

Figure 8:
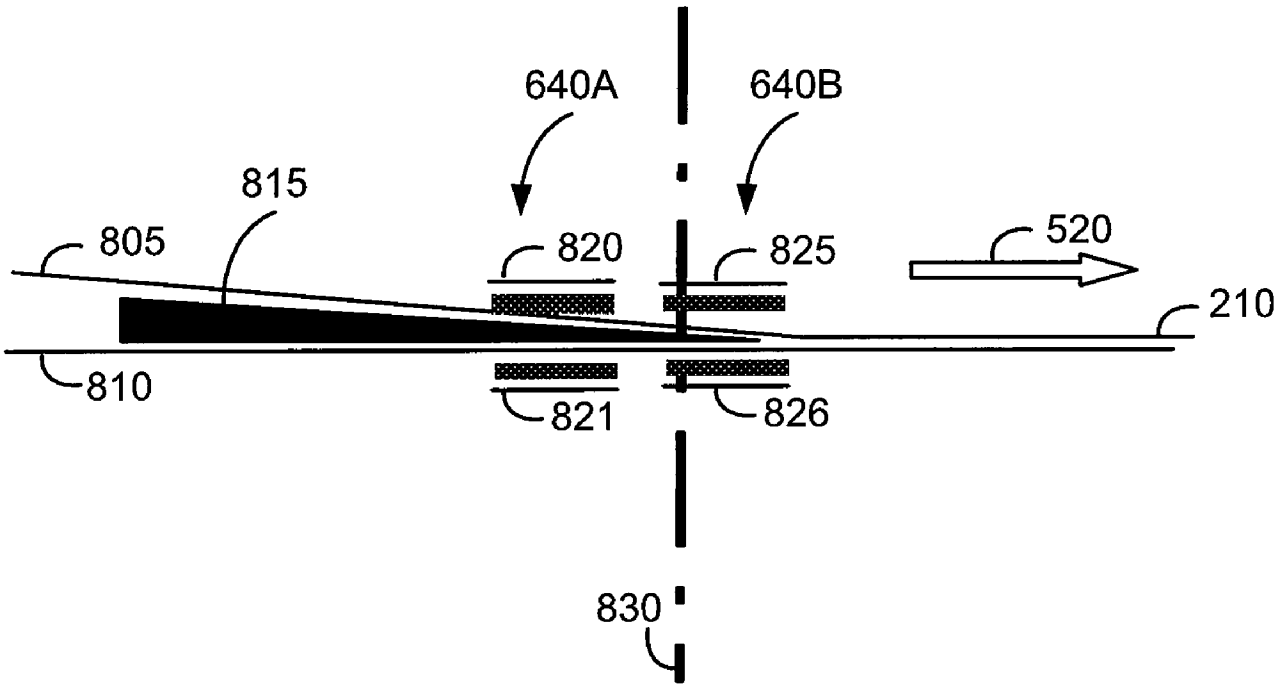
FIG. 8 is a cross-sectional view of the cutting heads and sewing heads of the cutting-sewing device, such as that shown in FIG. 6.

FIG. 8 is a cross-sectional view of the sewing heads of the cutting-sewing device, such as that shown in FIG. 6. A sewing head 640 (FIG. 6) may have the ability to move the garment material in a controlled way, such as, four degrees of freedom for each layer of garment material, $\{X, Y, \phi,\theta\}$. In this embodiment, the sewing heads 640A0-B includes upper pads 820, 825 and lower pads 821, 826, respectively, that are capable of moving in X, Y, and Theta independently and reciprocate as in a foot of an ordinary sewing machine. Because external movement of the garment material is generally coordinated with the local movement of the garment material, each head 640A0-B also has the ability to measure the net force required to move the garment material. This would typically have three components, X, Y, and Theta in the Euclidian sense as the vision measurement gives the conversion from one frame to another. In the case of sewing at a rate of, for example, 4000 stitches/minute, the same rate is likely used for the pad movements often called dogs in conventional sewing machines.

Optionally, a sewing head may have two sets of motion control and motion tracking, above and below, as well as the sewing device itself. Although FIG. 8 shows a polished separator plate 815 between a top and bottom set of pads, such a separator 815 may not be used. Rather, the top pads 820, 825 of the sewing heads 640A0-B may be creating the servo controlled stitch motion and the lower mechanism 821, 826 may be able to adjust the tension in one or more directions so that the end result is a control of the stitch in both top and bottom layers, respectively. This is more like the manual sewing case where only one pad is often used, that one pad usually called a dog.

Although the above description of stitch control has assumed that up to six degrees of freedom are controlled stitch to stitch, it is clear that stitch spacing, the distance between penetrations of the needle into the garment material may not be precisely controlled as it is the overall path of the stitches measured in the manner described here, thread count, that gives a garment or other sewn item its Shape. Thus the number of stitches to move a certain distance (thread counts) may not be precisely controlled. Hence, the motion of the pads or dogs, can be aimed at precise control of path, rather than precise control of individual stitches in the direction of overall motion. It should be noted that the servo controlling the pads or dogs includes use of moving coil, or voice coil motors, to achieve high performance.

Alternatively or additionally, optional equipment can be used along the peripheral of the standard machine that can be either fixed in the workspace or moved in an out automatically. An example is an arbor used to sew a tube around. Such an arbor would accept a sewing head 640 just as with the standard cutting-sewing device. Another fixture might make turning a partially assembled garment inside out easier.

In fact it is likely or possible that sewing heads 640 are attached to sewing machines that are moved into the workspace. The bottom of the head might be below the main work surface or above. In the above case, a special geometry to support cloth is likely.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

The invention claimed is:

1. A system for making a garment comprising:

a processing device;

a sewing module that sews garment material to facilitate making the garment; and memory that includes a thread count manager having instructions stored in the memory, the instructions being executed by the processing device, the instructions comprising logic configured to instruct the sewing module to sew the garment material based on counting threads of the garment material rather than using the geometric shape of pieces of garment material.

2. The system as defined in claim 1, wherein the garment material includes at least one of the following materials: woven or knit material and non-woven material, the woven material including textile and fabric and the non-woven material having property similar to woven and knit materials, where a pattern exists in the material that allows recognition of the shape of the material.

3. The system as defined in claim 2, wherein the non-woven material being configured to be applied to its surface any feature that enables the system to count "threads", the feature being well-defined and maintaining its attachment to the surface in the face of surface distortion.

4. The system as defined in claim 3, wherein the feature includes marking the non-woven material with removable or washable ink, the feature being applied to the surface of the non-woven material for sewing in the face of surface distortion.

5. The system as defined in claim 2, wherein the orientation of the edge of the garment material is described by the orientation in the warp or fill direction as the edge of the garment material is traversed.

6. The system as defined in claim 2, wherein the thread counting is of the woven material where the thread count is based on warp and fill when weaving in a loom, the warp being in the machine direction and fill being in the cross direction.

7. The system as defined in claim 2, wherein the thread counting is of a knit material where thread count is based on the formations used in the woven material.

8. The system as defined in claim 2, wherein the geometry of the garment material is described by counts in a manner where the perimeter of the garment material is in a closed loop, the perimeter of the garment material being mathematically described as a closed shape by way of a two or three dimensional array of thread counts including orientation.

9. The system as defined in claim 2, wherein the thread count manager has instructions that comprise logic configured to instruct the sewing module to sew the garment material based on the orientation of the threads.

10. The system defined in claim 1, wherein the thread count of a cut piece is measured after cutting and used by the sewing module to configure sewing of two or more pieces together based on at least one of the following: a calculated sequence of thread counts and the orientation of threads for both parts resulting in a sewn garment.

11. The system as defined in claim 1, wherein the sewing module is configured to sew the perimeter or markings on the garment material based on at least one of the following: tracking a pattern that amounts to following a predetermined sequence of thread counts and the orientation of threads.

12. The system as defined in claim 1, wherein the sewing module is configured to sew two or more pieces of material together based on at least one of the following: a predetermined sequence of thread counts and the orientation of threads for both parts, resulting in a sewn garment.

13. A system for making a garment comprising:

a processing device;

a cutting module that cuts the garment material to facilitate making the garment; and memory that includes a thread count manager having instructions stored in the memory, the instructions being executed by the processing device, the instructions comprising logic configured to instruct the cutting module to cut the garment material based on counting the threads of the garment material.

14. The system as defined in claim 13, wherein the cutting module cuts the garment material into discrete pieces based on the geometry of the garment material that is described by counts in a manner where the perimeter of the garment material is in a closed loop, the perimeter of the garment material being mathematically described as a closed shape by way of a two or three dimensional array.

15. The system as defined in claim 13, further comprising a vision module that inspects the garment material for defects during the cutting of the garment material.

16. The system as defined in claim 13, wherein the cut material is marked as part of the cutting process so as to facilitate subsequent sewing or cutting operations, or both.

17. The system as defined in claim 16, wherein the mark is applied by a printing process, which includes ink jet or contact device.

18. The system as defined in claim 17, wherein the mark is the result of a distinctive cut out of the garment material at an edge or in the interior.

19. A system for making a garment comprising:

a processing device;

a sewing module that sews garment material to facilitate making the garment;

a cutting module that cuts the garment material to facilitate making the garment; and memory that includes a thread count manager having instructions stored in the memory, the instructions being executed by the processing device, the instructions comprising logic configured to instruct the cutting module and sewing module to cut and sew the garment material based on counting the threads of the garment material rather than using the geometric shape of pieces of garment material.

20. The system as defined in claim 19, wherein the garment material includes at least one of the following materials: woven or knit material and non-woven material, the woven material including textile and fabric and the non-woven material including leather.

21. The system as defined in claim 20, wherein the non-woven material being configured to be applied to its surface any feature that enables the system to count "threads", the feature being well-defined and maintaining its attachment to the surface in the face of surface distortion.

22. The system as defined in claim 21, wherein the feature includes marking the non-woven material with removable or washable ink, the feature being applied to the surface of the non-woven material for sewing in the face of surface distortion.

* * * * *